US008068633B2

(12) United States Patent
Lee et al.

(10) Patent No.: US 8,068,633 B2
(45) Date of Patent: Nov. 29, 2011

(54) HEADPHONE CABLE SPLITTER

(75) Inventors: Noel Lee, Las Vegas, NV (US); Kevin Lee, El Cerrito, CA (US); Jacky Hsiung, San Jose, CA (US)

(73) Assignee: Monster Cable Products, Inc., Brisbane, CA (US)

( * ) Notice: Subject to any disclaimer, the term of this patent is extended or adjusted under 35 U.S.C. 154(b) by 790 days.

(21) Appl. No.: 12/183,718

(22) Filed: Jul. 31, 2008

(65) Prior Publication Data

US 2010/0027831 A1 Feb. 4, 2010

(51) Int. Cl.
*H04R 25/00* (2006.01)
*H04R 5/02* (2006.01)

(52) U.S. Cl. ..... 381/384; 381/309; 381/374; 381/380; 181/129; 181/130; 181/135; 379/430

(58) Field of Classification Search ..... 381/384, 381/380, 376, 374, 309; 181/129, 130, 135; 379/430; 174/659, 663, 664, 113 R, 114 R
See application file for complete search history.

(56) References Cited

U.S. PATENT DOCUMENTS

| | | | | |
|---|---|---|---|---|
| 2,353,070 | A * | 7/1944 | Pitkin, Jr. | 379/430 |
| 3,667,569 | A * | 6/1972 | Mackey et al. | 181/135 |
| 5,222,151 | A * | 6/1993 | Nagayoshi et al. | 381/380 |
| 5,422,957 | A | 6/1995 | Cummins | |
| 5,625,171 | A * | 4/1997 | Marshall | 181/130 |
| 6,922,473 | B2 * | 7/2005 | Turnbull | 381/74 |
| 2005/0036644 | A1 * | 2/2005 | Yang | 381/384 |
| 2006/0285715 | A1 * | 12/2006 | Drambarean et al. | 381/380 |
| 2007/0025579 | A1 * | 2/2007 | Kolton | 381/384 |
| 2008/0080732 | A1 * | 4/2008 | Sneed | 381/374 |
| 2009/0147982 | A1 * | 6/2009 | Ashida et al. | 381/384 |

OTHER PUBLICATIONS

SR-007MK2 Electrostatic Earspeakers, Apr. 1, 2008, http://www.stax.co.jp/Export/SR007mk2.html.
SR-404, Apr. 1, 2008, http//www.stax.co.jp/Export/SR404e.html.

* cited by examiner

*Primary Examiner* — Ngan Ngo
(74) *Attorney, Agent, or Firm* — LaRiviere, Grubman & Payne, LLP

(57) ABSTRACT

A flat, ribbon-like headphone cable having a unitary cable section, a splitter, and two split cable sections for connection to earpieces. The unitary and split cable sections each have substantially flat cross-sections wherein the width is substantially greater than the thickness. The split cable sections are oriented such that their widths are substantially perpendicular to the width of the unitary cable section.

2 Claims, 3 Drawing Sheets

HEADPHONE CABLE SPLITTER

TECHNICAL FIELD

The present invention relates to the field of cables. More specifically, the present invention relates to the field of headphone cables.

BACKGROUND ART

Ear-bud type headphones as are known in the art typically have thin cables that are prone to tangling. This tangling causes difficulty and delay for the user, who must untangle the headphone cable prior to actual use of the headphone, or else risk damage to the headphone cable due to knots or sharp folding of the cable. Even so, such damage may occur during the process of untangling the headphone cable, if such untangling is not performed in a careful manner.

A flat ribbon-like cable provides advantages in that its structure is inherently more rigid and therefore less prone to tangling. Moreover, the larger cross-sectional area of a flat cable facilitates passage of multiple conductors in a side-by-side configuration, as shown in FIG. 2. This provides benefits in terms of lower overall cable impedance and faster transient response as compared to conventional headphone cabling. Moreover, the flat cable can accommodate added functionality such as conductors for a microphone.

Headphone cables typically have a unitary section, in which the left and right channel conductors are combined in a single cable segment, and split left and right sections that connect to each of the left and right ear pieces. During usage of a flat headphone cable, it is desirable to orient the headphone cable so that its unitary cable section lays flat against the user's body. However, it is also desirable to orient the left and right split sections of the cable so that they lay flat against the user's face. This requires that the widths of the unitary cable section and the split cable sections be oriented in a substantially perpendicular relationship. Therefore, there is a need for a flat headphone cable incorporating a splitter that facilitates orientation of the widths of the unitary and split portions of the headphone cable in a substantially perpendicular relationship.

DISCLOSURE OF THE INVENTION

The present invention is directed towards a flat headphone cable having a unitary cable section and split cable sections, each of these cable sections having dimensions of length, thickness, and width. The cable sections are oriented such that the widths of the split cable sections are substantially perpendicular to the axis of the width of the unitary cable section.

The present invention enables a user of a flat headphone cable to orient the unitary cable section flat against his body, while the split cable sections lay flat against his face.

MODES FOR CARRYING OUT THE INVENTION

For ease of description within the present application, a flat cable is described as having dimensions of length, width, and thickness. The length of a flat cable is that dimension which is parallel to the conductors within the cable. The width and thickness of a flat cable are determined by measuring the dimensions of a cross-section orthogonal to the cable's length. The width is the longer dimension across the cross-section, while the thickness is the shorter dimension perpendicular to the width.

Figure 1:
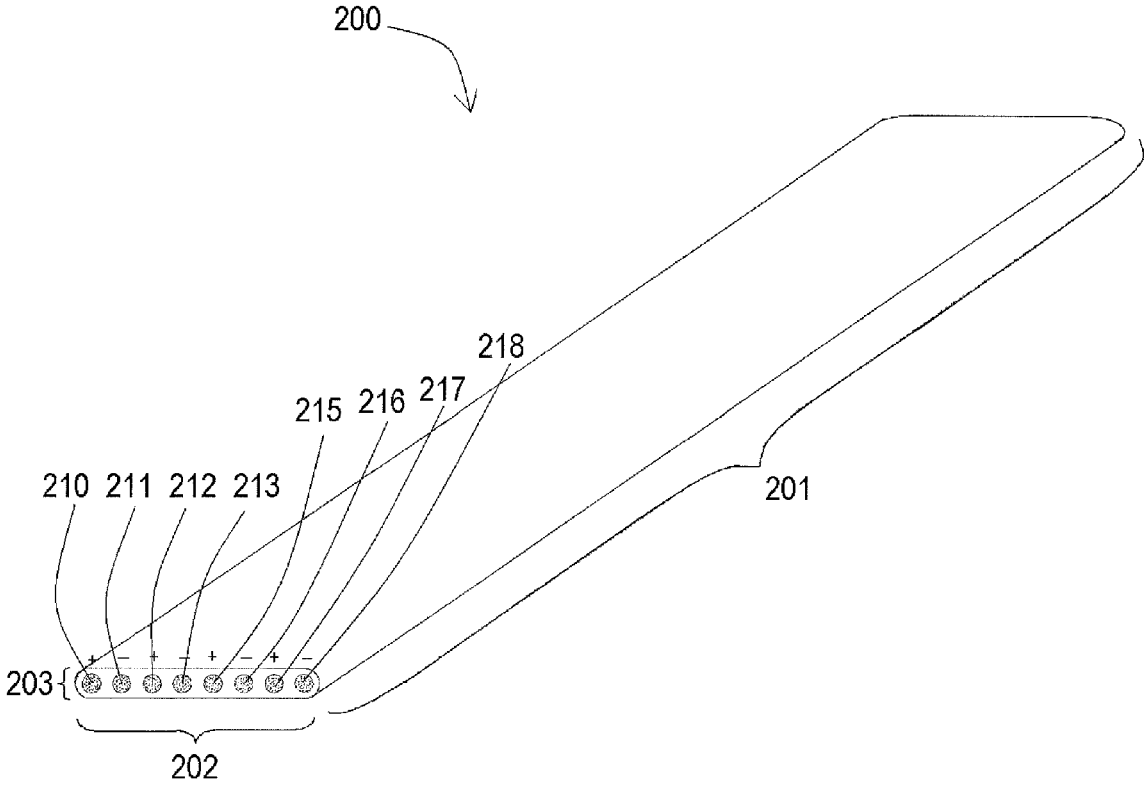
FIG. 1 is a cross-section view of a flat headphone cable, in accordance with the present invention.

FIG. 1 illustrates a flat headphone cable 200 having multiple conductors. The cable has a length 201 (that dimension parallel to the conductors), a width 202 (the longer of the cross-sectional dimensions) and a thickness 203 (the shorter of the cross-sectional dimensions).

Conductors 210-213 feed the left channel, and are arranged side-by-side in an alternating configuration of positive and negative conductors. Likewise, conductors 215-218 feed the right channel, and are similarly arranged in an alternating side-by-side fashion. The use of multiple duplicate conductors for each channel in an alternating positive/negative side-by-side configuration yields a headphone cable of lower impedance and faster transient response than conventional headphone cables. The result is enhanced audio fidelity and an improved listening experience for the user.

Figure 2:
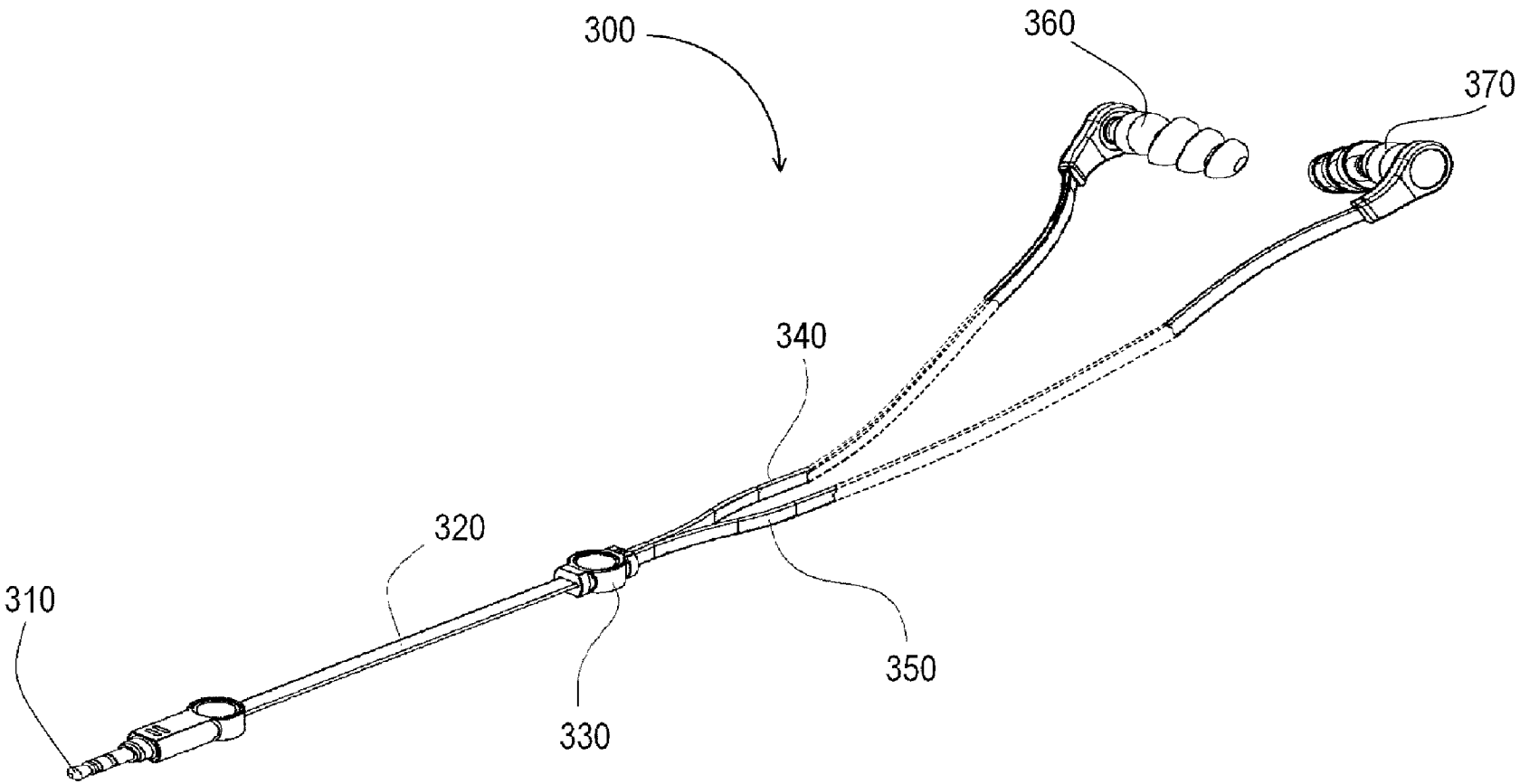
FIG. 2 is a perspective view of a flat headphone cable, in accordance with an embodiment of the present invention.

FIG. 2 illustrates a headphone cable 300 in accordance with an embodiment of the present invention. The headphone cable 300 has a connector 310, a unitary section 320, a splitter 330, and left and right split cable sections 340 and 350 which connect to the left and right earpieces 360 and 370. The connector 310 as shown is a ⅛" stereo connector plug, as is well known in the art. However, connector 310 may be other connector types and sizes as are known in the art, such as ¼", RCA, banana plug, etc.

The unitary section 320 has a substantially flat cross-section, wherein its width is substantially greater than its thickness. The width of section 320 is preferably three to ten times its thickness, though other ratios may apply. As an example, unitary section 320 may be a cable such as the cable 200 shown in FIG. 2, which has a width roughly eight times its thickness.

The splitter 330 facilitates splitting of the unitary cable section 320 into the two split cable sections 340 and 350, each of which have substantially flat cross-sections. The dimensions of the split cable sections may be similar or dissimilar to the dimensions of the unitary section 320. The widths of the two split cable sections 340 and 350 are oriented substantially perpendicular to the width of unitary cable section 320.

Figure 3:
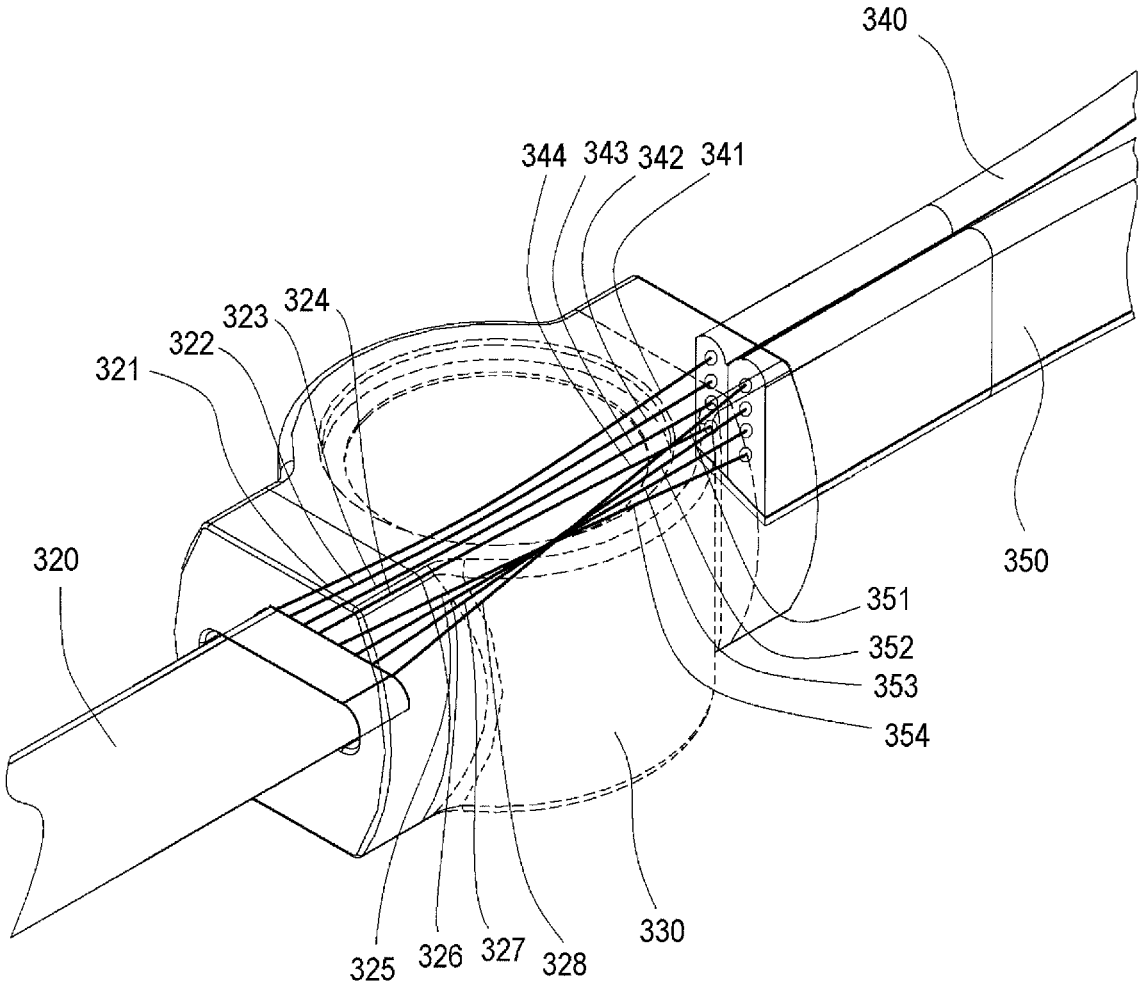
FIG. 3 is a cutaway view of a splitter, in accordance with an embodiment of the present invention.

FIG. 3 illustrates the interior details of splitter 330. Each of the conductors of unitary cable section 320 is electrically connected to a corresponding conductor in split cable sections 340 and 350. Unitary cable section 320 is shown having conductors 321-328, while split cable sections 340 and 350 have conductors 341-344 and 351-354, respectively. Conductors 321-324 are electrically connected to conductors 341-344, while conductors 325-328 are electrically connected to conductors 351-354. The electrical connection of the conductors may be accomplished by any means known in the art, such as direct contact, electrical soldering, etc. The housing of splitter 330 facilitates orientation of the widths of cables 340 and 350 perpendicular to the width of cable 320.

In an alternative embodiment of the invention (not shown), cable sections 320, 340 and 350 are formed from the same continuous cable segment. The splitting of cable 320 into left and right cable sections is accomplished by simply dividing cable 320 into its left and right portions 340 and 350. The left and right portions 340 and 350 are twisted 90 degrees relative to the unitary section 320, and each of the cable sections is secured in this orientation by the housing of the splitter 330.

Information as herein shown and described in detail is fully capable of attaining the above-described object of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, in which reference to an element in the singular is not intended to mean "one and only one" unless explicitly so stated, but rather "one or more."

All structural and functional equivalents to and combinations of the elements of the above-described preferred embodiment and additional embodiments that are known to those of ordinary skill in the art are hereby expressly incorporated by reference and are intended to be encompassed by the present claims. However, it should be readily apparent to those of ordinary skill in the art that various changes and modifications in form, apparatus material, and fabrication material detail may be made without departing from the spirit and scope of the invention as set forth in the appended claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. No claim herein is to be construed under the provisions of 35 U.S.C. §112, sixth paragraph, unless the element is expressly recited using the phrase "means for."

INDUSTRIAL APPLICABILITY

The present invention is industrially applicable to audio devices. More particularly, the present invention is industrially applicable to headphones and headphone cables.

What is claimed:

1. A headphone cable having the following sections:

a unitary cable section having left and right audio channel conductors, said unitary cable section having a cross-sectional width and thickness, said width being substantially greater than said thickness; and left and right cable sections electrically coupled to said left and right audio channel conductors, respectively, of said unitary cable section, and for connecting to the left and right earpieces of a headphone, said left and right cable sections having cross-sectional widths and thicknesses, said widths being substantially greater than said thicknesses, the left and right cable sections being oriented such that the widths of said left and right cable sections are substantially perpendicular to the width of said unitary cable section.

2. The headphone cable of claim 1, further having a splitter for splitting said unitary cable section into said left and right cable sections.

* * * * *